US009980550B2

(12) United States Patent
Caulier et al.

(10) Patent No.: US 9,980,550 B2
(45) Date of Patent: May 29, 2018

(54) DEVICE AND APPLICATOR FOR A COSMETIC PRODUCT

(71) Applicant: L'OREAL, Paris (FR)

(72) Inventors: Eric Caulier, Ferrieres (FR); Marcel Sanchez, Aulnay sous Bois (FR)

(73) Assignee: L'OREAL, Paris (FR)

( * ) Notice: Subject to any disclaimer, the term of this patent is extended or adjusted under 35 U.S.C. 154(b) by 0 days. days.

(21) Appl. No.: 14/910,324

(22) PCT Filed: Aug. 7, 2014

(86) PCT No.: PCT/FR2014/052063
§ 371 (c)(1),
(2) Date: Feb. 5, 2016

(87) PCT Pub. No.: WO2015/019029
PCT Pub. Date: Feb. 12, 2015

(65) Prior Publication Data

US 2016/0166044 A1 Jun. 16, 2016

(30) Foreign Application Priority Data

Aug. 8, 2013 (FR) ..... 13 57877

(51) Int. Cl.
*A45D 34/00* (2006.01)
*A45D 34/04* (2006.01)

(52) U.S. Cl.
CPC ..... *A45D 34/045* (2013.01)

(58) Field of Classification Search
CPC ..... A45D 34/045
USPC ..... 401/121–129
See application file for complete search history.

(56) References Cited

U.S. PATENT DOCUMENTS 5,588,447 A 12/1996 Gueret
6,033,143 A * 3/2000 Gueret ..... A45D 34/045 401/126
6,341,912 B1 * 1/2002 Gueret ..... A45D 34/045 401/118
8,191,558 B2 6/2012 Gueret
(Continued)

FOREIGN PATENT DOCUMENTS

DE 2737667 A1 2/1979
EP 0651955 A1 5/1995
EP 1407685 A1 4/2004
(Continued)

OTHER PUBLICATIONS

International Search Report for PCT/FR2014/052063, dated Jan. 9, 2015.

*Primary Examiner* — David Walczak
*Assistant Examiner* — Joshua Wiljanen
(74) *Attorney, Agent, or Firm* — The Marbury Law Group, PLLC

(57) ABSTRACT

The invention relates to an applicator for applying a product to the nails or to the skin, comprising:
- a gripping portion,
- a stem extending from the gripping portion along a longitudinal axis X-X, and
- an applicator member fixed in a housing at the free end of the stem.

Figure 1:
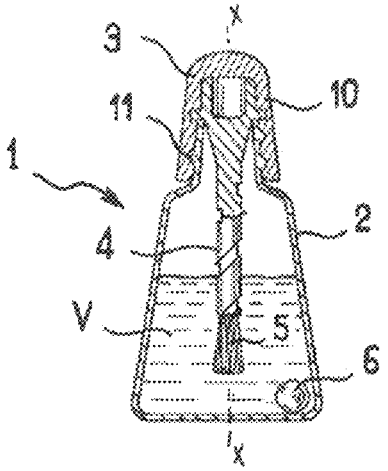

According to the invention, the stem of the applicator has, along the axis X-X, a succession of noncircular cross sections that are angularly offset with respect to one another about said axis X-X so as to form a helical pattern.

10 Claims, 2 Drawing Sheets

(56) References Cited

U.S. PATENT DOCUMENTS

| | | | |
|---|---|---|---|
| 2004/0096261 | A1 | 5/2004 | Gueret |
| 2009/0032046 | A1 | 2/2009 | Gueret |

FOREIGN PATENT DOCUMENTS

| | | | |
|---|---|---|---|
| EP | 2027792 | A1 | 2/2009 |
| JP | S6021214 | A | 2/1985 |
| WO | 2005087042 | A1 | 9/2005 |

* cited by examiner

DEVICE AND APPLICATOR FOR A COSMETIC PRODUCT

CROSS REFERENCE TO RELATED APPLICATION

This is a national stage application of PCT/FR2014/052063, filed internationally on Aug. 7, 2014, which claims priority to French Application No. 1357877, which was filed on Aug. 8, 2013.

The present invention relates to an applicator and a device for applying a cosmetic product to human keratin materials, in particular the skin or the nails.

The expression "cosmetic product" is understood to mean any product as defined in Regulation (EC) No 1223/2009 of the European Parliament and of the Council of 30 Nov. 2009 on cosmetic products. This cosmetic product may be, for example, a nail varnish, a foundation, or a lip gloss.

European patent EP 0 651 955 discloses a nail varnish applicator comprising a stem and bristles fixed in a housing in the stem, this housing having an oblong cross section.

Also known is a nail varnish applicator in which the stem comprises a plurality of longitudinal grooves distributed in a substantially uniform manner around its entire periphery. The longitudinal grooves allow the product deposited along the stem to flow preferentially toward the brush.

Finally, EP 1 407 685 discloses a nail varnish applicator in which the stem comprises one or two longitudinal grooves on its periphery.

A drawback of longitudinal grooves is that they cause the product to flow too rapidly toward the brush, and this can bring about overspills on application. In addition, the quantity of product stored in the groove is sometimes insufficient for the application of a relatively large quantity of product without reloading the brush in the container.

There is a need to make it easier to apply a product, in particular to the nails, and to make it possible to spread it more precisely. Specifically, the applicant has found that, with known applicators, the product which flows along the grooves in the stem is relatively difficult to spread with precision, since it flows too rapidly.

The object of the present invention is thus to provide an improved device for applying a cosmetic product in order to alleviate the abovementioned drawbacks.

To this end, the invention proposes an applicator for applying a product to the nails or to the skin, comprising a gripping portion, a stem extending from the gripping portion along a longitudinal axis X-X, and an applicator member fixed in a housing at the free end of the stem.

According to the invention, the stem has, along the axis X-X, a succession of noncircular cross sections that are angularly offset with respect to one another about said axis X-X so as to form a helical pattern.

The invention advantageously makes it possible to obtain less rapid flow of a larger quantity of product.

According to further features of the invention, the sections of the succession of noncircular cross sections may comprise a concavity so as to form a helical groove around the stem.

The sections of the succession of noncircular cross sections may comprise a protuberance so as to form a helical rib around the stem.

The sections of the succession of noncircular cross sections may be approximately circular outside the portion comprising said protuberance or said concavity.

The groove or the rib may have a gradient of between 10° and 70°, and in particular greater than or equal to 45°, with respect to an axis perpendicular to the axis X-X.

All of the sections of the succession of noncircular cross sections may be identical.

The applicator member may be a tuft of bristles fixed in the housing. The length of the portion of the bristles that extends outside the housing may then be between 5 and 20 mm.

The applicator member may be an end piece made of thermoplastic material.

The succession of noncircular cross sections may extend over more than half the height of the stem.

The succession of noncircular cross sections may extend as far as the free end of the stem.

The largest dimension of the opening in the housing, measured perpendicularly to the axis X-X, may be less than or equal to 5 mm, or even less than or equal to 3 mm.

The largest transverse dimension of a section of the stem may be less than or equal to 5 mm.

The stem may be produced in one piece with the gripping member by molding thermoplastic material.

The invention also relates to a device for packaging and applying a cosmetic product, comprising a container containing the product to be applied and an applicator as defined above.

Figure 2:
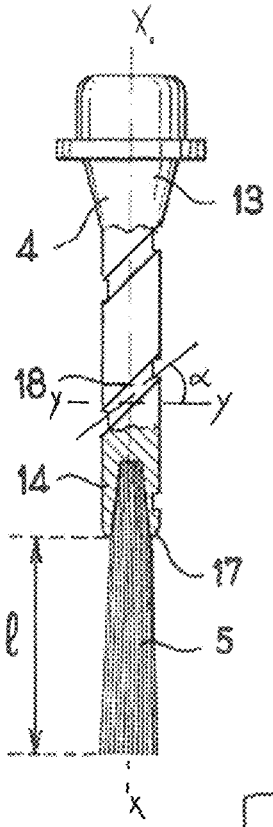
Figure 3:
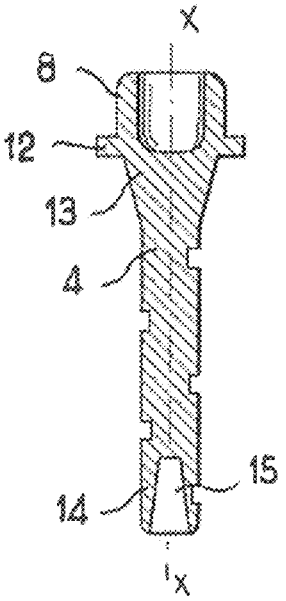
Figure 4:
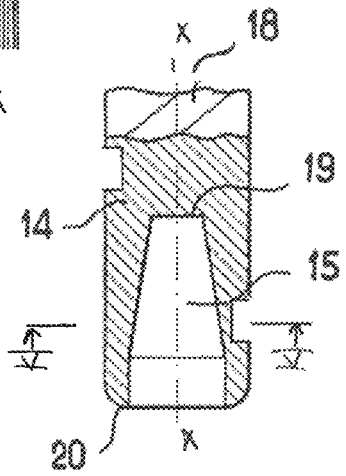
Figure 5:
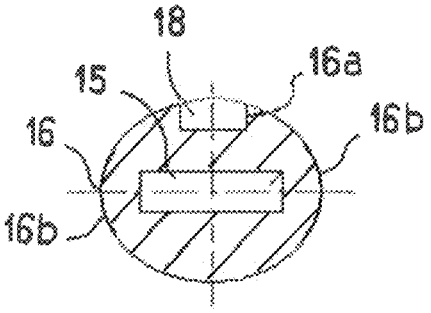
Figure 6:
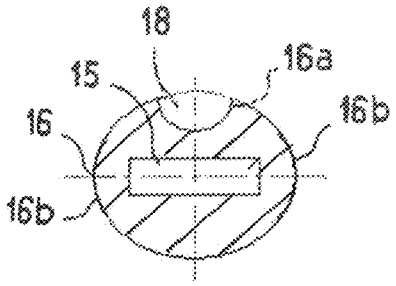
Figure 8:
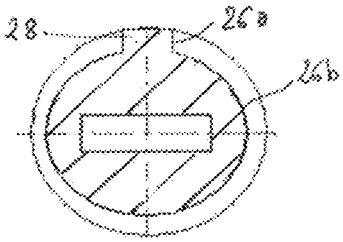
Figure 9:
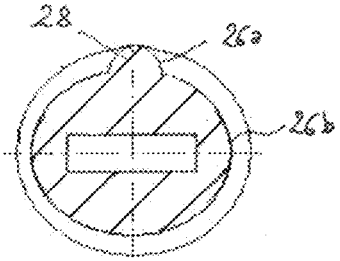
Figure 7:
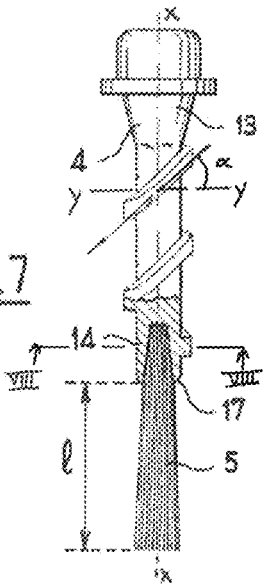
Figure 10:
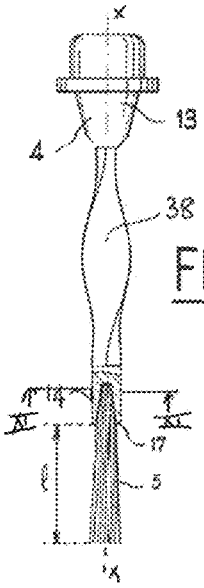
Figure 11:
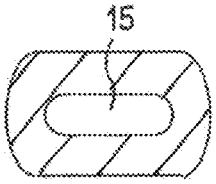
Figure 12:
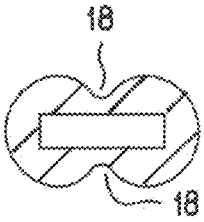
Figure 13:
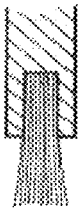
Figure 14:
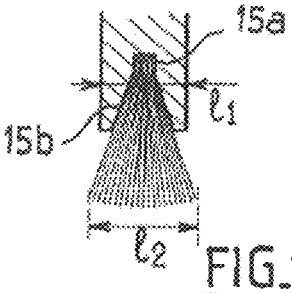
Figure 15:
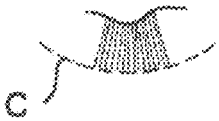
Figure 16:
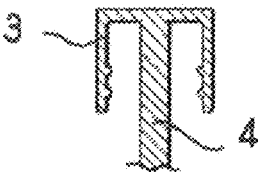

The invention may be better understood from reading the following detailed description of nonlimiting illustrative embodiments thereof and from examining the appended drawing, in which:

FIG. 1 is a schematic view, in axial section, of a device for applying a product to the nails, FIG. 2 partially shows the applicator of the device from FIG. 1, FIG. 3 shows the stem of the applicator from FIG. 1 on its own, in axial section, FIG. 4 shows a detail of the housing that holds the bristles of the brush, FIG. 5 is a cross section on V-V in FIG. 4, FIG. 6 shows a variant embodiment of the stem from FIG. 4 in section on V-V, FIG. 7 shows a second embodiment of the stem of the applicator of the invention, FIG. 8 is a cross section on VIII-VIII in FIG. 7, FIG. 9 shows a variant embodiment of the stem from FIG. 7 in section on VIII-VIII, FIG. 10 shows a third embodiment of the stem of the applicator of the invention, FIG. 11 is a cross section on XI-XI in FIG. 10, FIG. 12 shows a variant embodiment of the stem from FIG. 10 in section on XI-XI, FIGS. 13 and 14 illustrate two configurations of the housing, corresponding to different distributions of the bristles on the outside of the stem, FIG. 15 shows an end portion of the bristles of the brush on its own, and FIG. 16 is a partial longitudinal section through the stem and through a cap produced in one piece therewith.

FIG. 1 shows a device 1 for applying a cosmetic product to the nails, for example a nail varnish V. This device comprises a container 2 containing the varnish V and an applicator 3. The applicator comprises a plastics stem 4 extending along a longitudinal axis X-X, said stem being provided at one end with an applicator member formed by a brush 5 and at the other end with a gripping member 10 that likewise constitutes a cap for closing the container 2.

In a variant that is not shown, other types of applicator member can also be suitable, for example, but in a nonlimiting manner, the applicator member may be an end piece made of thermoplastic material or foam. These other types of applicator member may be suitable for different cosmetic products, such as liquid foundation or a lip gloss.

The applicator member may also be flocked.

The container 2 comprises an opening defined by a neck of the container 2. Preferably, the container 2 does not have a means for wiping the applicator member when the latter is withdrawn from the container 2.

The container may comprise a ball 6, for example a metal ball, for homogenizing the varnish V before application by shaking the device 1.

The container may be transparent or translucent. To this end, it may be made of glass.

Referring to FIGS. 2 to 5, it can be seen that the stem 4 comprises at its upper end a skirt 8 for fixing it in the closure cap 10. In a variant that is not shown, the stem may be produced in one piece with the closure cap of the container by molding plastic material.

The closure cap 10 is configured to be screw-fastened or snap-fastened on the neck 11 of the container 2.

Under the flange 12, the stem 4 comprises a conical part 13 that can help to seal the closure of the container 2 when the applicator 3 is in place on the latter. Sealing could also be obtained by interaction of surfaces of the cap 10 and of the neck 11 of the container 2.

The stem extends in an approximately rectilinear manner along the axis X-X from its conical part 13 to its free end 17. The largest transverse dimension of that portion of the stem that is dipped in the product contained in the container when the applicator is in place thereon can then be less than or equal to 5 mm.

The stem 4 also comprises a lower end portion 14 which is provided with a housing 15 for fixing the applicator member. In the example shown, the housing 15 receives a portion of the bristles of the brush 5, which are fixed for example by stapling, adhesive bonding, fusion or overmolding.

The opening in the housing 15 intersects the longitudinal axis X-X of the stem 4. Advantageously, the opening is perpendicular to this longitudinal axis X-X.

The housing 15 may have any kind of cross section, for example a circular or polygonal cross section. Advantageously, the housing 15 has an opening with a rectangular or oblong cross section, having an elongate shape along an axis perpendicular to the longitudinal axis X-X of the stem 4, thereby making it possible to obtain a substantially homogeneous distribution of the bristles.

As can be seen in FIG. 4, the housing 15 may have a cross section that decreases in size toward the bottom 19 of the housing. This decrease in size can be realized in accordance with the desired divergence for the bristles. Depending on the shape given to the housing 15, a more or less wide bundle of bristles can be obtained, as illustrated in FIGS. 13 and 14. FIG. 13 shows that by giving the housing 15 a substantially constant cross section, a brush in which the bristles are relatively tight is obtained, whereas by giving the housing 15 an outwardly divergent shape, the bristles are allowed to become increasingly spaced apart from one another so as to form a relatively wide bundle, as in FIG. 14.

The housing 15 may be produced with an indentation 15*a* in its base, the bristles being fixed to the stem in said indentation 15*a*. This indentation can open out onto a part 15*b* that flares in the direction of the opening in the housing 15, allowing the bristles to become spaced apart from one another so as to give the brush a widened shape and so that the bristles of the brush 5 are spaced apart when the brush is applied to the nail.

The housing 15 can then be produced such that the maximum transverse dimension l2 of the brush, measured perpendicularly to the axis X-X, is greater than the transverse dimension l1 of the stem at the housing 15, as can be seen in FIG. 14.

In particular, the housing can be arranged such that the bristles extend on the outside of the housing over a width, measured perpendicularly to the axis X-X, greater than the width of the stem at the housing. A relatively wide brush is then obtained.

The length of the portion of the bristles that extends outside the housing 15 in the stem is between 5 and 20 mm, for example.

The free ends of the bristles of the brush 5 may be situated, for example, as can be seen in FIG. 15, along an approximately circular curve C. Thus, the free ends of the bristles can describe more or less an arc of a circle, having a radius of curvature of between 2 and 15 mm for example, in particular between 4 and 10 mm. In a variant, the free ends of the bristles could be situated substantially along a straight line, for example.

The largest dimension of the opening in the housing, measured perpendicularly to the axis X-X, may be less than or equal to 2 mm.

The free end 17 of the stem 4 may comprises a chamfer 20, as can be seen in FIG. 4.

In the example illustrated in FIGS. 1 to 6, the stem 4 comprises a groove 18 along the major part of its length as far as its distal end 17. This groove 18 extends along and around the stem 4 so as to form a helical spiral. Thus, the stem 4 has, along the axis X-X, a succession of noncircular cross sections that are angularly offset with respect to one another about said axis X-X so as to form a pattern in the form of a helical groove 18. More specifically, the stem 4 has a succession of sections in which the external contour comprises a convex circular part 16*b* joining the edges of a concavity 16*a* defining the groove 18.

The concavity can have a polygonal profile, as in FIG. 5, or simply a profile in the form of a concave arc of a circle, as in FIG. 6.

This groove 18 may extend over more than half the height of the stem 4. Said groove 18 extends preferably from the distal end 17 of the stem 4 so as to lead onto the applicator member.

The groove has a gradient of between 10° and 70° with respect to an axis Y-Y perpendicular to the axis X-X. Advantageously, the gradient is greater than or equal to 45° with respect to an axis Y-Y perpendicular to the axis X-X. The gradient is in particular adapted to the viscosity of the product so as to obtain a flow rate suitable for the desired use.

The stem may also comprise a plurality of grooves that may or may not cross one another.

In a variant shown in FIGS. 7 to 9, the stem comprises a rib 28 extending along and around the stem so as to form a helical rib. Thus, the stem has, along the axis X-X, a succession of noncircular cross sections that are angularly offset with respect to one another about said axis X-X so as to form a pattern in the form of a helical rib 28. More specifically, the stem 4 has a succession of sections in which the external contour comprises a convex circular part 26*b* joining the edges of a convex protuberance 26*a*.

The protuberance can have a polygonal profile, as in FIG. 8, or simply a profile in the form of a concave arc of a circle, as in FIG. 9.

This rib 28 may extend over more than half the height of the stem 4. Said rib extends preferably from the distal end 17 of the stem 4.

The rib 28 has a gradient of between 10° and 70° with respect to an axis Y-Y perpendicular to the axis X-X. Advantageously, the gradient is greater than or equal to 45° with respect to an axis Y-Y perpendicular to the axis X-X.

In a variant shown in FIGS. 10 to 12, the stem comprises a flattened cross section, and more particularly a succession of flattened cross sections, and said stem 4 comprises a twisted portion 38 about the longitudinal axis X-X. Thus, the stem has, along the axis X-X, a succession of flattened, i.e. noncircular, cross sections that are angularly offset with respect to one another about said axis X-X so as to form a helical pattern.

More specifically, the stem 4 has a succession of noncircular sections, for example rectangular or oblong sections, as in FIG. 11, or flattened sections having a protuberance or concavity, as in FIG. 12.

The noncircular cross sections of the succession may be identical or vary in a progressive manner.

The twisted portion 38 may extend over more than half the height of the stem 4 and extend as far as the distal end 17 of the stem 4, or not.

The angular offset forming the twist may be between a quarter turn and 6 turns. The twist may extend along a length of between 10 mm and 70 mm.

Advantageously, the twisted portion 38 stops at the bottom 19 of the housing 15 in order to have a nontwisted housing.

The device 1 is used in the following manner.

The user agitates the container 2 to allow the ball 6 to homogenize the varnish V and then the user unscrews the cap 10 and uses the brush 5 to apply the product.

When the applicator 3 is withdrawn from the container 2, product is present on the stem 4 and flows by gravity in the direction of the brush 5. The product thickness is greater at the grooves 18, which can retain more product.

The product flows along the helical pattern, and thus more slowly than if it were to flow axially along the stem. This makes it possible to apply the product more easily and more precisely without having to reload the brush by replacing it in the container.

The invention is not limited to the examples illustrated. The features of the various examples can in particular be combined as parts of variants which are not illustrated.

Thus, it is also possible to have a plurality of grooves or ribs with identical or different shapes on one and the same stem. Similarly, a stem can comprise both a groove and a rib.

The expression "comprising a" should be understood as meaning "comprising at least one", unless specified to the contrary.

The invention claimed is:

1. An applicator for applying a product to the nails or to the skin, comprising:

a gripping portion;

a stem extending from the gripping portion along a longitudinal axis, the stem having, along the longitudinal axis, a succession of noncircular cross sections that are angularly offset with respect to one another about the longitudinal axis so as to form a helical pattern; and an applicator member comprising a tuft of bristles fixed in a housing disposed at a free end of the stem, the bristles extending from the housing along the longitudinal axis, wherein the sections of the succession of noncircular cross sections comprise a concavity so as to form a helical groove around the stem, or a protuberance so as to form a helical rib around the stem, the groove or the rib having a gradient ranging from 10° to 70° with respect to an axis perpendicular to the longitudinal axis, or in that the stem comprises a succession of flattened cross sections, the stem comprising a twisted portion about the longitudinal axis.

2. The applicator of claim 1, wherein all of the sections of the succession of noncircular cross sections are identical.

3. The applicator of claim 1, wherein the bristles extend from the housing by a length ranging from 5 to 20 mm.

4. The applicator of claim 1, wherein the applicator member is an end piece made of thermoplastic material.

5. The applicator of claim 1, wherein the succession of noncircular cross sections extends over more than half the height of the stem.

6. The applicator of claim 1, wherein the succession of noncircular cross sections extends as far as the free end of the stem.

7. The applicator of claim 1, wherein the largest dimension of the opening in the housing, measured perpendicularly to the longitudinal axis, is less than or equal to 3 mm.

8. The applicator of claim 1, wherein the largest transverse dimension of a section of the stem is less than or equal to 5 mm.

9. The applicator of claim 1, wherein the stem is produced in one piece with the gripping member by molding thermoplastic material.

10. A device for packaging and applying a cosmetic product, comprising:

a container containing the cosmetic product to be applied, and an applicator comprising:

a gripping portion;

a stem extending from the gripping portion along a longitudinal axis, the stem having, along the longitudinal axis, a succession of noncircular cross sections that are angularly offset with respect to one another about the longitudinal axis so as to form a helical pattern; and an applicator member comprising a tuft of bristles fixed in a housing disposed at a free end of the stem, the bristles extending from the housing along the longitudinal axis, wherein the sections of the succession of noncircular cross sections comprise a concavity so as to form a helical groove around the stem, or a protuberance so as to form a helical rib around the stem, the groove or the rib having a gradient ranging from about 10° to about 70° with respect to an axis perpendicular to the longitudinal axis, or in that the stem comprises a succession of flattened cross sections, the stem comprising a twisted portion about the longitudinal axis.

* * * * *